US009458856B2

(12) United States Patent
Keegan

(10) Patent No.: US 9,458,856 B2
(45) Date of Patent: Oct. 4, 2016

(54) ARRANGEMENT IN WHICH AN INNER CYLINDRICAL CASING IS CONNECTED TO A CONCENTRIC OUTER CYLINDRICAL CASING

(75) Inventor: Colm Keegan, Nettleham (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 498 days.

(21) Appl. No.: 14/118,647

(22) PCT Filed: Apr. 27, 2012

(86) PCT No.: PCT/EP2012/057840

§ 371 (c)(1),
(2), (4) Date: Jan. 29, 2014

(87) PCT Pub. No.: WO2012/159851

PCT Pub. Date: Nov. 29, 2012

(65) Prior Publication Data

US 2014/0133972 A1 May 15, 2014

(30) Foreign Application Priority Data

May 24, 2011 (EP) ..... 11167345

(51) Int. Cl.
*F04D 29/40* (2006.01)
*F01D 25/14* (2006.01)
(Continued)

(52) U.S. Cl.
CPC ..... *F04D 29/40* (2013.01); *F01D 25/145* (2013.01); *F01D 25/164* (2013.01); *F01D 25/24* (2013.01); *F01D 25/26* (2013.01); *F05D 2230/642* (2013.01); *F05D 2250/311* (2013.01); *F05D 2260/30* (2013.01)

(58) Field of Classification Search
CPC .... F01D 25/164; F01D 25/145; F01D 25/24; F01D 25/26; F01D 25/30; F01D 11/005; F05D 2260/30
See application file for complete search history.

(56) References Cited

U.S. PATENT DOCUMENTS 2,220,616 A 11/1940 Roder
4,032,253 A 6/1977 Ryncosky et al.
(Continued)

FOREIGN PATENT DOCUMENTS

FR 2951232 A1 4/2011
GB 206603 A 11/1923
(Continued)

*Primary Examiner* — Craig Kim
*Assistant Examiner* — Maxime Adjagbe

(57) ABSTRACT

An arrangement having inner and outer cylindrical casings connected by a cylindrical connector is presented. The connector is disposed between and concentric with the inner and outer casings and is stiff in direction of concentric axis but flexible in direction radially with respect to concentric axis such that relative thermal expansion of inner and outer cylindrical casings in radial direction is permitted simultaneously maintaining relative position of the casings in axial direction. The connector has annular first and second ends secured to inner and outer casings respectively, and a cylindrical main body between first and second ends flexible in radial direction. The main body has cylindrical first and third sections, annular second section. The first section extends axially away from the first end to a radially inner pat of the second section. The third section extends axially from a radially outer part of the second section towards the second end.

7 Claims, 3 Drawing Sheets

(51) Int. Cl.

| | |
|---|---|
| ***F01D 25/16*** | (2006.01) |
| ***F01D 25/24*** | (2006.01) |
| ***F01D 25/26*** | (2006.01) |

(56) References Cited

U.S. PATENT DOCUMENTS

| | | | |
|---|---|---|---|
| 4,304,522 | A | 12/1981 | Newland |
| 4,478,551 | A | 10/1984 | Honeycutt, Jr. |
| 5,526,640 | A | 6/1996 | Brooks |
| 6,099,165 | A | 8/2000 | Tremaine |

FOREIGN PATENT DOCUMENTS

| | | | |
|---|---|---|---|
| GB | 221632 | A | 9/1924 |
| GB | 219023 | A | 10/1925 |
| GB | 243974 | A | 12/1925 |
| WO | WO 03085236 | A1 | 10/2003 |

ARRANGEMENT IN WHICH AN INNER CYLINDRICAL CASING IS CONNECTED TO A CONCENTRIC OUTER CYLINDRICAL CASING

CROSS REFERENCE TO RELATED APPLICATIONS

This application is the U.S. National Stage of International Application No. PCT/EP2012/057840 filed Apr. 27, 2012 and claims benefit thereof, the entire content of which is hereby incorporated herein by reference. The International Application claims priority to the European application No. 11167345.5 EP filed May 24, 2011, the entire contents of which is hereby incorporated herein by reference.

FIELD OF INVENTION

The present invention relates to an arrangement in which an inner cylindrical casing is connected to a concentric outer cylindrical casing.

BACKGROUND OF INVENTION

More particularly the present invention relates to such an arrangement comprising: an inner cylindrical casing; an outer cylindrical casing concentric with the inner cylindrical casing; and a connector connecting the inner and outer cylindrical casings.

SUMMARY OF INVENTION

The present invention finds particular application in the field of gas turbine engines.

In one known gas turbine engine, combustion gas travels from an annular array of turbine blades to an exhaust system via an annular cross-section passage. The annular cross-section passage is formed by radially inner and outer concentric casing walls. Radial spokes extend between the radially inner and outer concentric casing walls, across the annular cross-section passage, thereby providing a structural connection between the inner and outer casing walls. The radially inner and outer concentric casing walls together with the radial spokes are typically known as the spoked frame. Located concentrically within the spoked frame is a bearing housing containing a rotor mounted on bearings.

The bearing housing must be connected to the spoked frame such that the rotor is located concentrically and in the correct axial position, and is supported with sufficient stiffness to ensure stability. When the gas turbine engine is started from cold all the components are at room temperature, but in a steady state running condition the spoked frame contains combustion gas typically at 500 to 600 degrees C., whereas the bearing housing contains oil typically at 80 to 100 degrees C. As a result the spoked frame expands more than the bearing housing, so that a connection between them, meeting the stiffness and location criteria, will tend to suffer from high stress, leading to fatigue failure.

One method of solving this problem is to separate the spoked frame from the combustion gas using an insulating lining, so that the spoked frame's running temperature is reduced to give acceptable differential expansion between the spoked frame and the bearing housing. This method is successfully used in current gas turbine engines, but adds complexity and cost.

An alternative solution is to allow the spoked frame to see the combustion gas temperature, and to cope with the resulting expansion using sliding joints. Typically this is achieved using dowels running in radial holes with a sliding fit, or with blocks running in slots, arranged to allow sliding in the desired direction. Sliding joints can be difficult to engineer so that they don't suffer from excessive wear, and add cost and complexity to the assembly.

According to the present invention there is provided an arrangement in which an inner cylindrical casing is connected to a concentric outer cylindrical casing, the arrangement comprising: an inner cylindrical casing; an outer cylindrical casing concentric with the inner cylindrical casing; and a connector connecting the inner and outer cylindrical casings, wherein the connector comprises a cylindrical connector disposed between and concentric with the inner and outer cylindrical casings, wherein the cylindrical connector is stiff in the direction of the concentric axis but flexible in the direction radially with respect to the concentric axis such that relative thermal expansion of the inner and outer cylindrical casings in the radial direction is permitted whilst simultaneously maintaining the relative position of the casings in the axial direction, wherein the cylindrical connector comprises an annular first end secured to the inner cylindrical casing, an annular second end secured to the outer cylindrical casing, and a cylindrical main body between the annular first and second ends, the cylindrical main body being flexible in the radial direction thereby to permit relative thermal expansion of the inner and outer cylindrical casings in the radial direction, wherein the cylindrical main body comprises a cylindrical first section, an annular second section, and a cylindrical third section, the cylindrical first section extending generally axially away from the annular first end to a radially inner part of the annular second section, the cylindrical third section extending generally axially from a radially outer part of the annular second section towards the annular second end.

BRIEF DESCRIPTION OF DRAWINGS

The invention will now be described, by way of example, with reference to the accompanying drawings, in which.

DETAILED DESCRIPTION OF INVENTION

Figure 1:
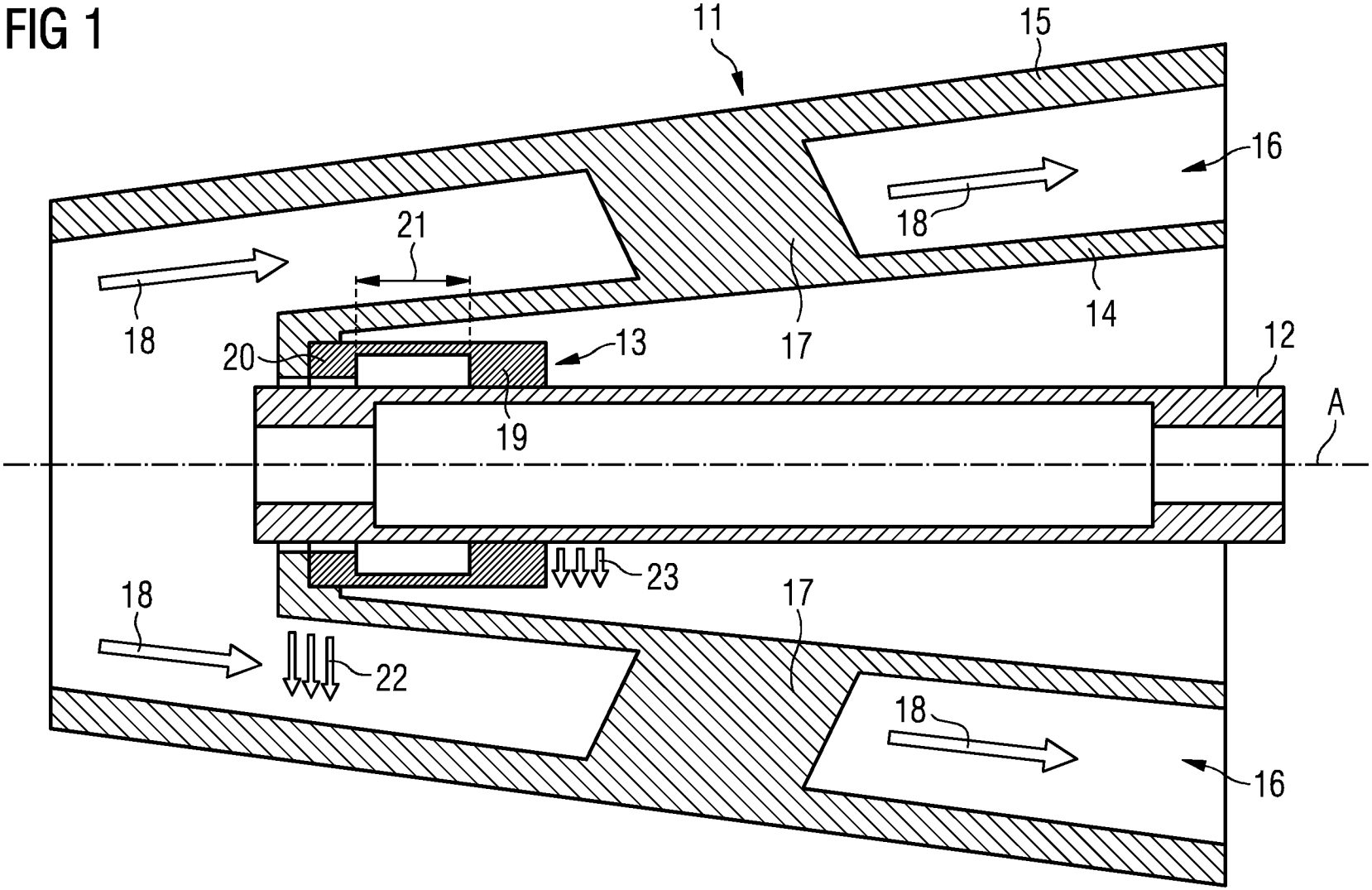
FIG. 1 is a longitudinal cross-section of a portion of a gas turbine engine including a first cylindrical connector that is not in accordance with the present invention but is useful for understanding the present invention.

The portion of a gas turbine engine shown in FIG. 1 comprises a spoked frame 11, a bearing housing 12, and a first connector 13. The components 11, 12, 13 are all generally cylindrical in form, and are all concentric about the axis A.

The spoked frame 11 comprises radially inner and outer concentric casing walls 14, 15 forming an annular cross-section passage 16, and radial spokes 17 extending between the walls 14, 15 across the passage 16 to provide a structural connection between the walls. In use of the gas turbine engine, hot combustion gas travels as shown by the arrows 18 in FIG. 1, from an annular array of turbine blades (not shown) to the left of FIG. 1 via the annular cross-section passage 16 to an exhaust system (also not shown) to the right of FIG. 1.

The bearing housing 12 is located within the spoked frame 11, and contains a rotor (not shown) mounted on bearings (also not shown).

The first connector 13 is disposed between the bearing housing 12 and the spoked frame 11, and operates to mount the bearing housing concentrically with the spoked frame and also to maintain the correct axial position of the bearing housing relative to the spoked frame. The first connector 13 comprises an annular first end 19 secured to the bearing housing 12, an annular second end 20 secured to the spoked frame 11, and a cylindrical main body 21 between the annular first and second ends 19, 20.

With the exception of the radial spokes 17 of the spoked frame 11, all the components of FIG. 1 are axi-symmetric about axis A.

The first connector 13 is stiff in the axial direction to maintain the axial position of the bearing housing 12 relative to the spoked frame 11, however, in the radial direction, the first connector is flexible to accommodate relative radial thermal expansion of the bearing housing and spoked frame. In achieving steady state operation of the gas turbine engine, the temperature of the spoked frame will increase by a much greater amount than that of the bearing housing. This will give rise to greater expansion radially outward of the spoked frame as compared to the bearing housing. In FIG. 1, longer arrows 22 indicate the greater radially outward expansion of the spoked frame, and shorter arrows 23 indicate the lesser radially outward expansion of the bearing housing. This difference in expansion is permitted by radially outward flexing or bending of the cylindrical main body 21 of the first connector (the second end 20 of the connector will expand radially outward more than the first end 19 of the connector which will cause radially outward flexing or bending of the connector). In other words, the shape of the first connector is such that the temperature of its second end 20 can be increased significantly relative to its first end 19 without this causing excessive stress due to the consequent greater radial expansion of the second end as compared to the first end. Thus, it will be seen that differential radial expansion of the spoked frame and bearing housing can occur without placing undue stress on the components.

Figure 2:
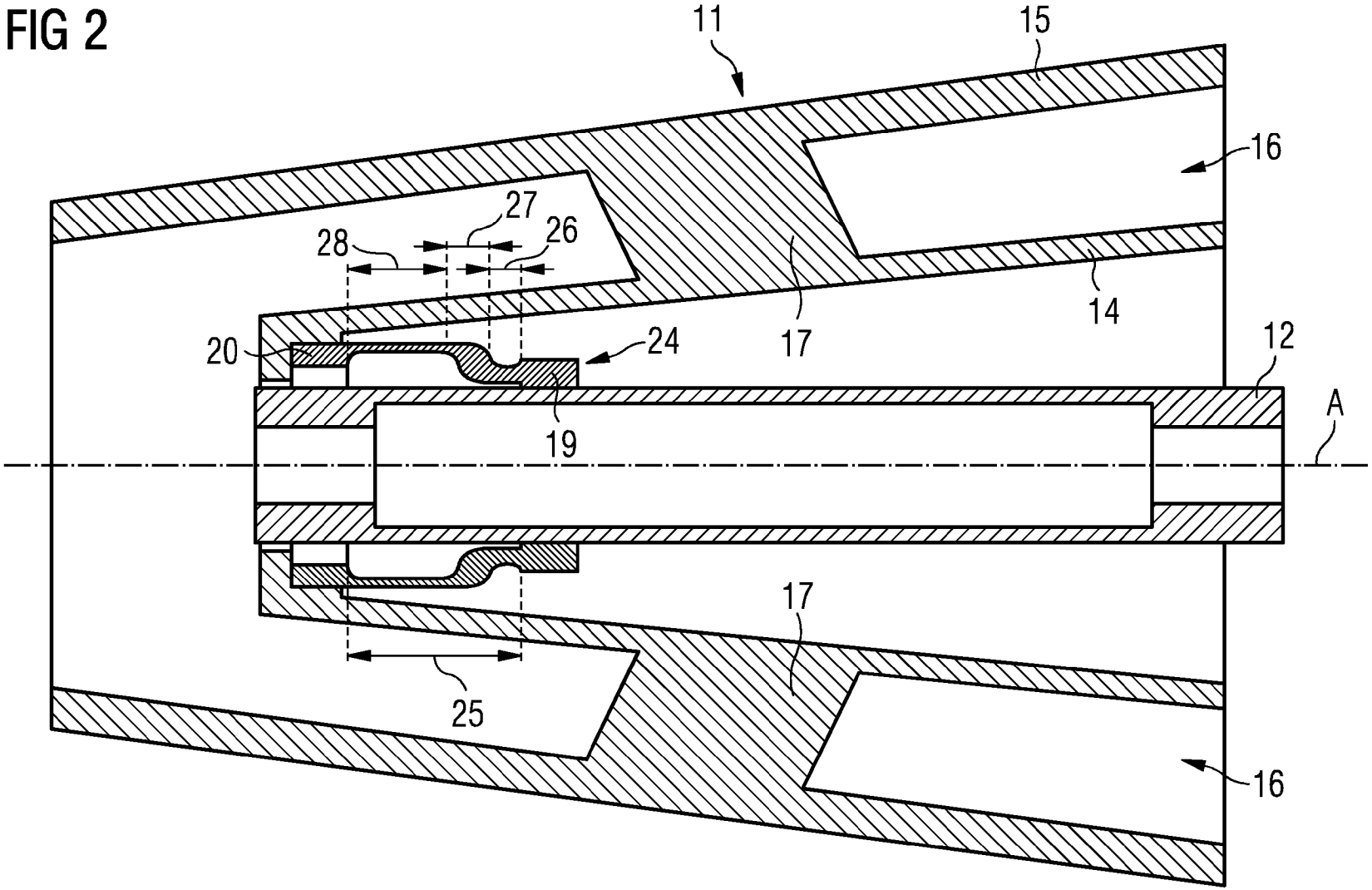
FIG. 2 is the same as FIG. 1 except that the first cylindrical connector has been replaced by a second cylindrical connector that is in accordance with the present invention.

The second cylindrical connector 24 of FIG. 2 differs from the first cylindrical connector 13 of FIG. 1 in the form of its cylindrical main body 25 between its annular first and second ends 19, 20. Its cylindrical main body 25 comprises a cylindrical first section 26, an annular second section 27, and a cylindrical third section 28. The cylindrical first section 26 extends generally axially from the annular first end 19 of the second connector 24 to a radially inner part of the annular second section 27. The cylindrical third section 28 extends generally axially from a radially outer part of the annular second section 27 to the annular second end 20 of the second connector. The axial length of the cylindrical first section 26 is less than that of the cylindrical third section 28, and the radial thickness of the walls of the cylindrical first section 26 is greater than that of the walls of the cylindrical third section 28.

As with the first connector 13, the second connector 24 is stiff in the axial direction to maintain the axial position of the bearing housing 12 relative to the spoked frame 11, but flexible in the radial direction to permit relative radial thermal expansion of the bearing housing and spoked frame; however, due to the S-shaped form of the cylindrical main body 25 of the second connector, the second connector is more flexible in the radial direction than the first connector. The S-shaped form further relieves the stress of the relative radial expansion.

Figure 3:
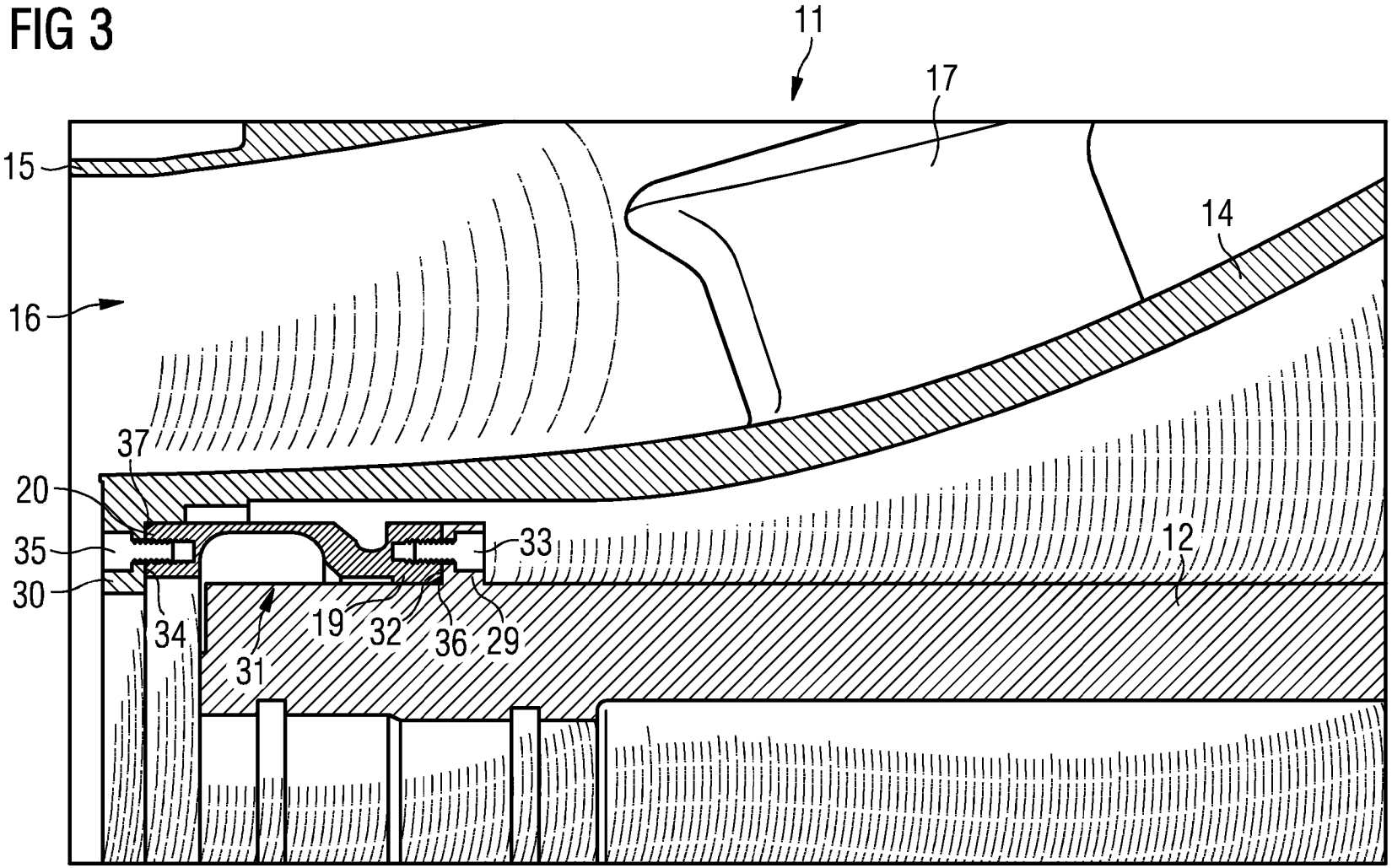
FIG. 3 is a sectioned view of a portion of a gas turbine engine including a third cylindrical connector that is in accordance with the present invention.

In the portion of the gas turbine engine shown in FIG. 3, the bearing housing 12 includes a first annular flange 29 that extends radially outwardly, and the radially inner casing wall 14 of the spoked frame 11 includes a second annular flange 30 that extends radially inwardly. The third connector 31 of FIG. 3 is very similar to the second connector 24 of FIG. 2. The annular first end 19 of the third connector 31 is secured to axially facing side 32 of the first annular flange 29 by means of axially extending bolts 33, and the annular second end 20 of the third connector is secured to axially facing side 34 of the second annular flange 30 by means of axially extending bolts 35. The annular first end 19 includes a radially internal spigot connection 36 to the bearing housing 12, and the annular second end 20 includes a radially external spigot connection 37 to the radially inner casing wall 14. The spigot connections 36, 37 assist in ensuring concentricity of the components. The third connector 31 has a reduced radial extent as compared to the second connector 24 of FIG. 2. In this regard, the radial space available between the spoked frame 11 and the bearing housing 12 is limited, as can be seen in FIG. 3.

As with the first and second connectors, the third connector is stiff in the axial direction to maintain the axial position of the bearing housing relative to the spoked frame, but flexible in the radial direction to permit relative radial thermal expansion of the bearing housing and spoked frame.

The S-shaped form of the cylindrical main body of the second and third connectors comprises a single 'S'. This need not be the case and the cylindrical main body could comprise a number of S's end to end, i.e. the cylindrical main body could comprise a series of convolutions.

It is to be noted that the flexibility in the radial direction of the above first to third connectors must not be so great that there is not sufficient bearing support for rotor-dynamic stability, i.e. the radial stiffness must provide sufficient bearing support for rotor-dynamic stability.

The first to third connectors flex or bend in the radial direction due to the difference in thermal expansion in the radial direction of their second, relatively hot ends 20 with respect to their first, relatively cold ends 19. This flexing or bending subjects the connectors to bending stress. The connectors must be sufficiently flexible in the radial direction that this bending stress is not too great without being so flexible that there is not sufficient bearing support for rotor-dynamic stability. The S-shaped form of the cylindrical main body of the second and third connectors provides a good balance between these competing requirements.

It is advantageous that the connector between the bearing housing and the spoked frame be a separate component rather than being integral with the bearing housing/spoked frame: (i) as a separate component it can be made in a more elaborate shape than would possible if it were integral; and (ii) as a separate component it can be made of a higher strength material than could economically be justified if it were integral.

The shape of the above first to third connectors is such that they can be accommodated in limited radial space.

The present invention is not only applicable in the field of gas turbine engines but wherever there is a requirement to connect an inner cylindrical casing to a concentric outer cylindrical casing, and the connection must be such as to accommodate relative radial expansion of the casings whilst at the same time maintaining the relative axial position of the casings.

The invention claimed is:

1. An arrangement for a gas turbine engine in which an inner cylindrical casing is connected to a concentric outer cylindrical casing, comprising:

an inner cylindrical casing;

an outer cylindrical casing concentric with the inner cylindrical casing; and a connector connecting the inner and the outer cylindrical casings, wherein the connector comprises a cylindrical connector disposed between and concentric with the inner and the outer cylindrical casings, wherein the cylindrical connector is stiff in a direction of a concentric axis but flexible in a direction radially with respect to the concentric axis such that a relative thermal expansion of the inner and the outer cylindrical casings in the radial direction is permitted whilst simultaneously maintaining a relative position of the inner and the outer cylindrical casings in the axial direction, wherein the cylindrical connector comprises:

an annular first end secured to the inner cylindrical casing, an annular second end secured to the outer cylindrical casing, and a cylindrical main body between the annular first and the second ends, wherein the cylindrical main body is flexible in the radial direction to permit the relative thermal expansion of the inner and the outer cylindrical casings in the radial direction, wherein the cylindrical main body comprises:

a cylindrical first section, an annular second section, and a cylindrical third section, wherein the cylindrical first section extends axially away from the annular first end to a radially inner part of the annular second section, wherein the cylindrical third section extends axially from a radially outer part of the annular second section towards the annular second end.

2. The arrangement according to claim 1, wherein an axial length of the cylindrical first section is less than that of the cylindrical third section, and wherein a radial thickness of walls of the cylindrical first section is greater than that of walls of the cylindrical third section.

3. The arrangement according to claim 1, wherein the inner cylindrical casing comprises a first annular flange that extends radially outwardly, wherein the outer cylindrical casing comprises a second annular flange that extends radially inwardly, wherein the annular first end is secured to an axially facing side of the first annular flange, and wherein the annular second end is secured to an axially facing side of the second annular flange.

4. The arrangement according to claim 3, further comprising axially extending fasteners securing the annular first end to the axially facing side of the first annular flange and securing the annular second end to the axially facing side of the second annular flange.

5. The arrangement according to claim 1, wherein the annular first end comprises a radially internal spigot connection to the inner cylindrical casing, and wherein the annular second end comprises a radially external spigot connection to the outer cylindrical casing.

6. The arrangement according to claim 1, wherein the inner and the outer cylindrical casings comprise components of a gas turbine engine.

7. The arrangement according to claim 6, wherein the inner cylindrical casing comprises a housing for a rotor of the gas turbine engine, and wherein the outer cylindrical casing comprises a frame that conveys combustion gas produced by the gas turbine engine.

* * * * *